US005427378A

United States Patent [19]

Murphy

[11] Patent Number: 5,427,378

[45] Date of Patent: Jun. 27, 1995

[54] GOLF BALL AND METHOD OF MAKING SAME

[76] Inventor: James A. Murphy, 16324 Wilson Farm Dr., Chesterfield, Mo. 63005-4541

[21] Appl. No.: 179,536

[22] Filed: Jan. 10, 1994

[51] Int. Cl.[6] ..... A63B 37/12; A63B 37/14

[52] U.S. Cl. ..... 273/235 A; 273/213

[58] Field of Search ..... 273/213, 235 R, 235 A, 273/235 B

[56] References Cited

U.S. PATENT DOCUMENTS

| | | | |
|---|---|---|---|
| 2,861,810 | 11/1958 | Veatch | 273/213 |
| 3,031,194 | 4/1962 | Strayer | 273/213 |
| 4,235,441 | 11/1980 | Ciccarello | 273/213 |
| 4,679,794 | 7/1987 | Yamada et al. | 273/235 R |
| 4,679,795 | 7/1987 | Melvin et al. | 273/235 R |
| 4,798,386 | 1/1989 | Berard | 273/235 R |
| 4,865,326 | 9/1989 | Isaac et al. | 273/235 A |
| 4,991,851 | 2/1991 | Melesio | 273/213 |
| 5,000,458 | 3/1991 | Proudfit | 273/235 A |
| 5,000,458 | 3/1991 | Proudfit | 273/213 X |
| 5,007,647 | 4/1991 | Gulick | 273/213 |
| 5,018,742 | 5/1991 | Isaac et al. | 273/235 A |
| 5,029,870 | 7/1991 | Concepcion et al. | 273/235 A |

*Primary Examiner*—George J. Marlo

*Attorney, Agent, or Firm*—Polster, Lieder, Woodruff & Lucchesi

[57] ABSTRACT

A high visibility light reflective golf ball is provided. The golf ball has light reflective material on the surface of the resin cover. The reflective material is fashioned as particles from aluminized polyester, aluminum foil, Metalflake © Paint, or holographic film. In the preferred embodiment the material is incorporated into a clear coat applied to the cover. In alternative embodiments, the material is incorporated in or on the resin cover or in a paint applied to the resin cover and then protected with a clear finish coat. The percentage of surface of the ball covered with the reflective material may vary, preferablly in a range of 5% to 75% of the surface area, depending upon the light reflective properties desired.

13 Claims, 2 Drawing Sheets

GOLF BALL AND METHOD OF MAKING SAME

BACKGROUND OF THE INVENTION

This invention relates generally to golf balls, more particularly to a high visibility, light reflecting golf ball having particles of light reflective material on its outer surface to reflect sunlight thereby enhancing visibility of the ball during flight or at rest.

Many golfers, no matter what their skill level, are often frustrated by their inability to see the golf ball after hitting it down a fairway. Obviously, the golf ball is more difficult to see and find if it lands in the rough, trees, weeds or a water hazzard. It is particularly frustrating, however, to hit the ball relatively straight and still lose it on the fairway. This often occurs when the golfer loses sight of the ball in flight. A golfer can lose sight of the ball, in flight, because of the lighting conditions, cloud cover, or background. As the golf ball sails away from the golfer, it has a tendancy to blend into the background of the sky, particularly if the sky is cast in shades of white or light blue. If there is no cloud cover and the sun light is extremely bright, the golfer also may lose sight of the ball as a result of the sunlight. This happens because golf balls, although primarily manufactured or sold in the color white, are not intended to glisten or shine in sunlight. Once the golfer loses sight of the ball in flight, it is more difficult to locate the ball after it lands.

Moreover, if the ball lands in the rough, in the woods, or in shallow water it may be lost. A number of prior art golf balls have been introduced in an attempt to rememdy the problem of lost golf balls. For example, golf balls are now available in colors, such as bright orange, flourescent yellow, pink, blue and so on. U.S. Pat. No. 4,798,386 to Berard discloses a golf ball having a fluorescent material admixed in the cover material. The examples offered by a Berard include fluorescent material comprised of Day-Glo Saturn Yellow, and Lemon Yellow to color the golf balls a bright or fluorescent yellow. However, these colored balls are unsatisfactory, as far as remedying the problem of losing sight of the ball, for a number of reasons.

First, coloring the golf ball has very little to do with enhancing the visibility of the golf ball in flight. Colored golf balls do not shine, glisten or reflect sun light any better than a traditional white golf ball. Once the golf ball rises in the air, its color and the velocity make it generally indistigushable regardless of how it is colored. The main advantage of the colored golf ball is that it provides some enhanced visability on the fairway or in the rough. This is a result of the fact that the colored golf ball offers a color contrast to the surroundings. In most cases the golf ball is surrounded by green grass, green weeds, or perhaps brown or tan dried grass, weeds or leaves. An orange, yellow, pink, or blue ball may be more readily seen under these conditions, but is not designed in a way to actively attract your attention.

Second, many colored golf balls, for example pink or pastel blue balls are not designed to improve visability; these pastel color balls being provided in various colors for aesthetic and marketing reasons only. These balls are primarily marketed to female golfers.

Another disadvantage of the colored golf balls is that they do not appeal to many traditional golfers. The orange or yellow balls are simply too different from traditional white balls to be universally popular. Golfers who prefer to play with a traditional ball would prefer a traditional white ball with improved visability characteristics.

Because of the demand for traditional white golf balls, golf ball, manufacturers have attempted to improve or enhance the "whiteness" of the ball. For example, U.S. Pat. No. 4,679,794, to Yamada et al. discloses a golf ball with an enhanced white appearance. U.S. Pat. No. 4,679,795 to Melvin et al. provides a golf ball having optical brightners in the cover. U.S. Pat. No. 4,865,326 to Isaac et al. also provides for optical brightners in the golf ball clear coating. U.S. Pat. No. 5,000,458 to Proudfit discloses a golf ball with an optical brightner in the primer coat. U.S. Pat. No. 5,018,742 to Isaac et al. discloses an improvement in the appearance of golf balls consisting of an optical brightner in the clear coating. U.S. Pat. No. 5,029,870 to Concepcion et al. discloses a white painted balata covered golf ball using a white base urethane paint containing blue and violet agents to enhance the whiteness of the golf ball.

These inventions primarily address the ball's overall appearance and do very little to remedy the problem of losing sight of the golf ball in flight, for obvious reasons. Golf balls that have enhanced "whiteness" may have improved aesthetic appeal, but they do not glitter, shine or reflect sunlight any better than a conventional white golf ball. Even though a "whiter" golf ball may appear to be somewhat easier to spot on the fairway or in the rough due to the color contrast, a whiter ball has no special light reflecting properties to reflect sunlight so as to actively draw attention to it. As stated above, the main purpose of enhancing the brightness or whiteness of a golf ball is to make it aesthetically pleasing since the cover, either Surlyn © or balata, is not a pure white in color.

SUMMARY OF THE INVENTION

It is a principal object of the invention to provide a golf ball having a light reflective surface that will reflect sunlight during flight of the ball thereby increasing visibility of the ball during flight.

Another object of the invention is to provide a golf ball having a light reflective surface that will reflect sunlight when the ball is at rest thereby increasing visibility of the ball in a fairway, rough or in shallow water.

Another object of the invention is to provide a golf ball having light reflective material on its surface that increase the visibility of the ball by reflecting sunlight during flight or at rest.

Still another object of the invention is to provide a golf ball having a variable ratio of reflective material to surface area thereby increasing or decreasing the light reflective property of the ball.

A still further object of the invention is to provide a golf ball having light reflective material on the surface that retains an appearance similar to conventional golf balls.

Yet another object of the present invention is to provide a light reflective golf ball that is easy, simple and economical to manufacture and well suited for its intended purposes.

Briefly stated a high visibility, light reflective golf ball is provided. The ball has a standard golf ball core, a resin cover surrounding the core, and light reflective material on the surface of the cover to reflect sunlight thereby rendering the ball more highly visible in flight or at rest. In the preferred embodiment, light reflective material is fashioned as particles and incorporated in a clear coat which is applied to the surface of the resin cover. In another embodiment, the material is incorporated in a paint which is applied to the resin cover. In yet another embodiment, the light reflecting material is imbedded in the resin cover and then coated with a protective clear coat. In all embodiments, the ratio of light reflective material to surface area of the golf ball may be varied so as to increase or decrease the light reflective properties of the golf ball. An optimum range would be 5% to 75% of the ball's surface covered by the reflective material.

IN THE PREFERRED EMBODIMENT

Figure 1:
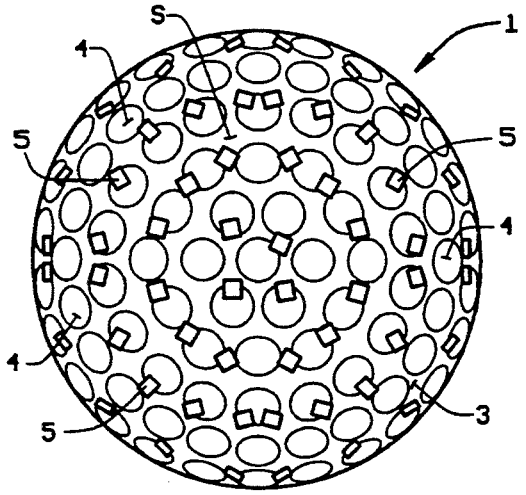
FIG. 1 is an enlarged, perspective view of a golf ball of the present invention having a very small percentage of the surface area covered by light reflective material.
Figure 2:
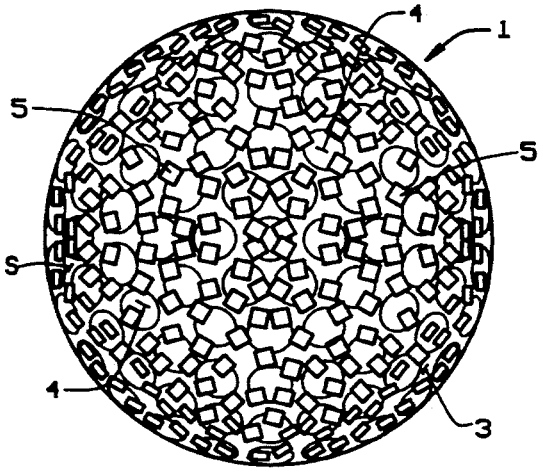
FIG. 2 is an enlarged, perspective view of a golf ball of the present invention having a moderate percentage of its surface area covered by light reflective material.
Figure 3:
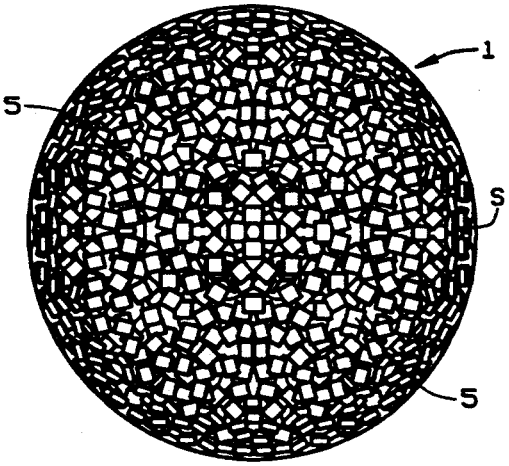
FIG. 3 is an enlarged, perspective view of a golf ball of the present invention having a high percentage of its surface area covered with light reflective material.
Figure 1A:
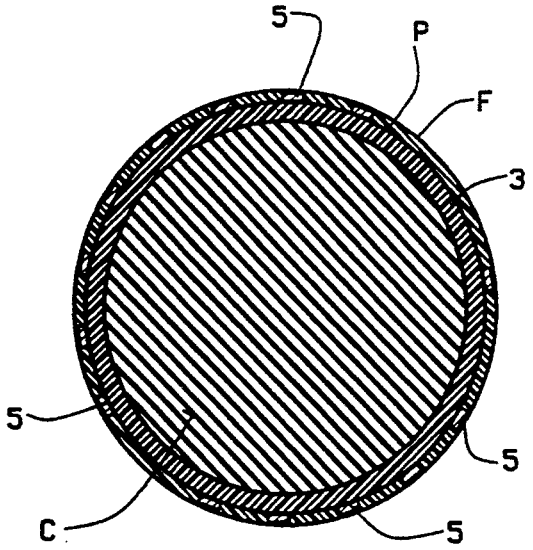
FIG. 1A is a cross-sectional view of a golf ball of the present invention showing the discrete light reflecting particles in the paint layer.

A high visability, light reflective golf ball made in accordance with the principles of the present invention as indicated generally by reference numeral 1 in FIGS. 1–3. In general, golf ball 1 is constructed in accordance with manufacturing techniques known in the art. Golf ball 1 can be constructed by bonding a cover 3 about a core C (FIG. 1A). Cover 3 can be either compression molded from two half shells or it can be injection molded as a fluid about the core. Cover 3 can be made from a natural resin such as balata, or from a synthetic resin such a Surlyn © (E.I. Dupont, Wilmington, Del.). Cover 3 has a plurality of conventional indentations or dimples 4 formed in surface S. Cover 3 may have a painted finish P, for example, a white painted finish or a color painted finish, such as orange, yellow, pink or blue. However, in the preferred embodiment, the cover has a white finish.

The painted finish P is applied through a process known in the art. For example, a golf ball having a cover 3 of a synthetic resin is sand blasted, washed, dried and then a primer coat of paint is applied. The primer is dried at about 100° F. A first white coat is applied and dried at about 100° F. A second white coat is applied and dried at about 100° F. A trademark or advertising logo is stamped onto the cover and then a clear finish coat F is applied and dried at about 100° F. Generally, two clear coats are applied. First, a clear primer is applied and then an outermost clear coating is then applied. The outermost clear coat F is generally referred to in the art as a "finish coat". The clear coat materials are known to the art and are generally epoxies or urethanes. Where two clear coats are used, the first is usually an epoxy or a one pack urethane, and the second a two pack urethane consisting of separate packages of polyol and then diisocyanate.

Figure 1B:
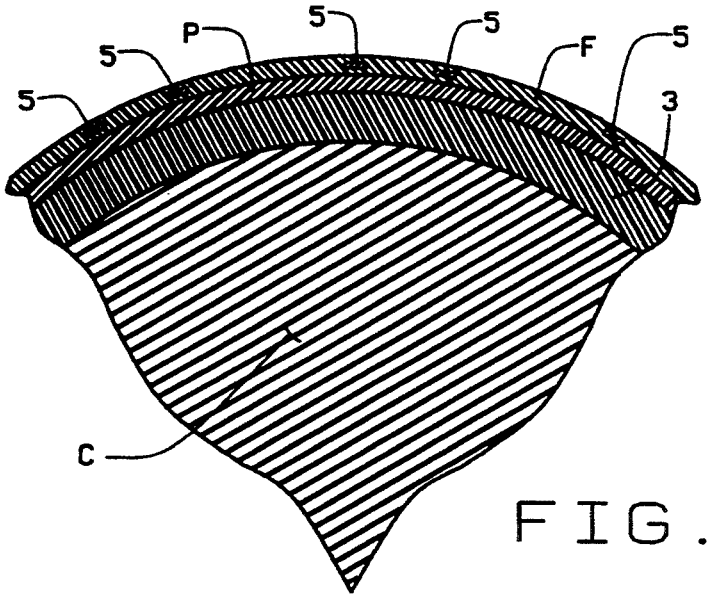
FIG. 1B is an enlarged partial cross-sectional view of the golf ball of the present invention showing the discrete light reflecting particles in the clear coat.
Figure 1C:
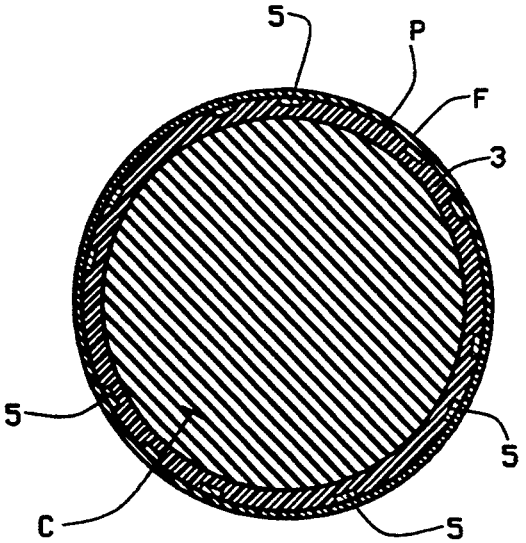
FIG. 1C is a cross-sectional view of the golf ball of the present invention showing the discrete light reflecting particles in the ionomer cover.

Referring now to FIGS. 1–3, golf ball 1 has a plurality of individual light reflective particles 5 distributed evenly about the surface S of the golf ball 1. Particles 5 are also referred to as "glitter specks". In the preferred embodiment particles 5 are incorporated into i.e. suspended in the first clear primer coat F (FIG. 1B). However, the particles 5 may be incorporated in the last clear primer coat or finish coat. Moreover, the glitter specks or particles 5 may be admixed into the cover material 3 (FIG. 1C) and then covered with clear coat. And, as will explained below, the particles 5 can be incorporated in a paint P (FIG. 1A), applied to the cover, and then protected with clear coat.

The size and quantity of particles applied to the surface of the golf ball can vary depending upon the reflective property desired. In the drawings, particles 5 are enlarged for clarity of illustration. The size of particle 5 can vary from very small to large, but generally range from 0.002"×0.002"×0.00045" in thickness to 0.125" square, with a thickness of 0.002". Particles 5 or squares having dimensions of 0.035" by 0.035 by 0.00045" in thickness function particularly well. The amount of particles 5 on surface S of ball 1 can be varied as a percentage of the area of surface S. For example, a standard size golf ball has a diameter of 1.68" and a surface area of approximately 8.86" sq. inch ($S=\pi D^2$). Therefore, ten particles of 0.035 square inch would cover approximately 0.35 square inch or approximately 4% of the surface area of the golf ball. As shown in FIG. 1, ball 1 has very few particles 5, that is, 10–15 particles are evenly dispersed on the surface S of ball 1 providing a ball with a approximately 4 to 10% of its surfaces covered by reflective particles 5.

FIG. 2 illustrates ball 1 having approximately 25 to 50% of its surface S covered with particles 5. This arrangement provides a ball 1 having increased light reflective properties. FIG. 3 illustrates ball 1 having 75–90% of surface S area covered with particles 5. This particular application renders ball 1 particularly light reflective. The ball, however, bears less resemblance to a traditional ball. It should be understood, therefore, the amount of surface S covered by particles 5 may be varied from less than 1% to 100% of the surface, depending upon the desired light reflective properties sought by the user and the resemblance to a traditional ball that is also desired. The fewer number of particles on surface S of golf ball 1 the more golf ball 1 will resemble a traditional white golf ball. However, too few particles will leave the ball insufficently reflective. Therefore a optimal range would be 5% to 75% of the surface area covered with particles 5.

Particles 5 are formed from an appropriate light reflective material such a metallized polyester or coated aluminum metallized polyethylene terephthalate, available commercially as Poly*Flake (Giltterex, Cranfield, N.J.), polyester foil, such as Polyester Jewels (Meadowbrook Inventions, Bernardsville, N.J.), highly polished aluminum foil, polished to a mirror-like surface such as Metallic Jewels (Meadowbrook Inventions, Bernardsville, N.J.) or holographic film particles (Spectratek, Los Angeles, Calif.). These products can be incorporated into the urethane coat F (FIG. 1B) or epoxy coat and appropriately applied. Furthermore, particles 5 can be provided in a commercially available white acrylic laquer or other colored laquer and applied directly as the paint coat P (FIG. 1A) and then covered with a clear coat (FIG. 1A). Such particle-containing acrylic laquer paints are commercially available, for example Metalflake © Paint (Metalflake, Aimsbury, Mass.).

Figure 4:
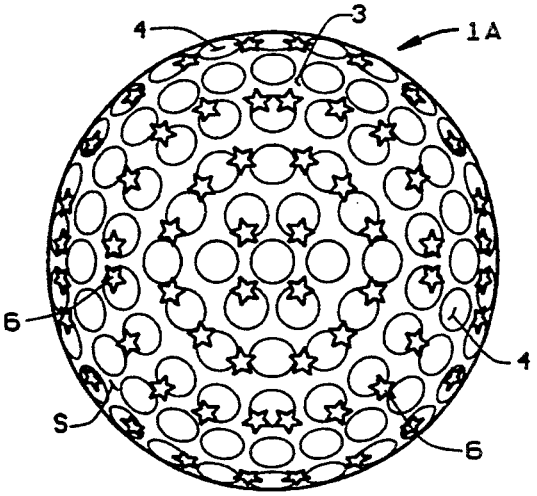
FIG. 4 is an enlarged perspective view of a golf ball of the present invention employing a star-shaped light reflective particle covering a moderate percentage of the surface area of the golf ball.
Figure 5:
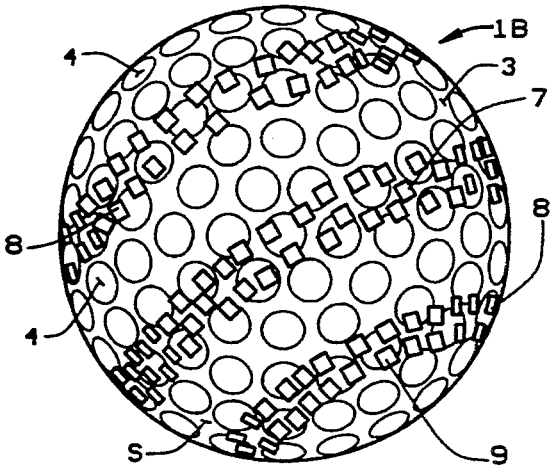
FIG. 5 is an enlarged perspective view of the golf ball of the present invention employing light reflective material on the surface of the golf ball in a distinct band pattern.
Figure 6:
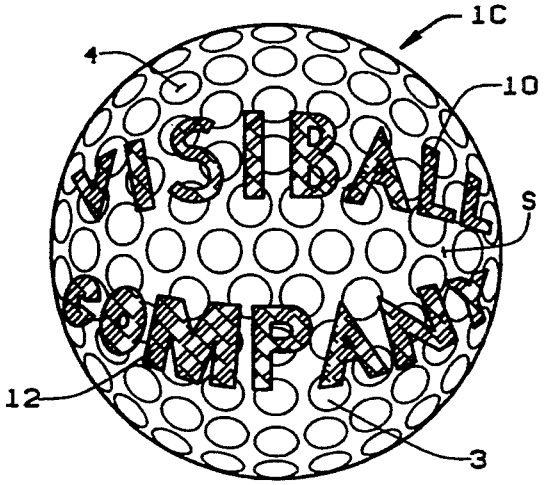
FIG. 6 is an enlarged perspective view of the golf ball employing light reflective material arranged on the surface of the golf ball in the shape of a logo.

FIGS. 4–6 illustrate alternative embodiments of the light reflective golf ball. FIG. 4 illustrates a golf ball 1A having a plurality of particles on surface S, of cover 3, the particles being cut in the shape of a star 6. Stars 6 are approximately 3/16" by 0.002" thick. As described above, relative to FIGS. 1–3, the amount of surface S covered by stars 6 may vary depending upon the relative amount of reflective surface desired by the user. The optimum range of surface area covered by reflective stars 6 should be in the range of 5% to 75%. It may be noted also, that the stars 6 are intended to be illustrative only. The individual material can be cut in any desired shape, including stars, for decorative as well as reflective purposes. FIG. 5 illustrates a ball 1B having a distinct band pattern 7 of individual particles 9 wound about surface S of cover 3. Band pattern 7 of particles 9, tends to optimally reflect light from ball 1B as ball 1B rotates in flight. However any distinct pattern may be used.

FIG. 6 illustrates another embodiment of the golf ball of the present invention indicated generally be reference numeral 1C. Ball 1c has a trademark or advertising logo 10 on surface S comprised of individual reflective particles 12 applied to cover 3. Cover 3, as well as logo 10, is then protected by an appropriate finish coat. It should be understood that the trademark or the logo 10 in FIG. 6 is intended to be illustrative only, and that any trademark, logo, ball characteristic (i.e. compression), individual name, company name may be used. It should be understood that the term logo, as used herein as well as in the appended claims, is intended to cover any writing, message, numeral or script desired, including but not limited to the foregoing examples. The size of logo 10 relative to surface S will vary depending upon the amount of reflective surface desired by the user.

It should be noted that various modifications may be made in the invention without departing from the scope of the claims. Variations on the number, size and shape of the reflective particles have been described. Furthermore, the particles could include facets to enhance the reflective properties. Moreover, the reflective material can be used on balls of surface color other than white, without departing from the scope of the invention. Therefore, the foregoing description and accompanying illustrations are intended to be illustrative only and should not be viewed in a limiting sense.

I claim:

1. In a golf ball having a core, an outer cover comprised of a resin cover material surrounding the core, and a protective coating over the cover, the improvement comprising:

a plurality of individual light reflective particles randomly dispersed over a surface of the ball and suspended in said protective coating applied to the cover to reflect light thereby rendering the golf ball more highly visible.

2. The improvement of claim 1 wherein the light reflective particles comprises approximately 1%–100% of a surface area of the golf ball.

3. The improvement of claim 1 wherein said light reflective particles are arranged in a distinct pattern on a surface of the golf ball.

4. The improvement of claim 3 wherein said pattern is a logo.

5. The golf ball of claim 1 wherein said light reflective particles are contained in a paint applied to said cover.

6. The golf ball of claim 1 wherein said light reflective particles occupy 5% to 75% of a total surface area of said cover.

7. The golf ball of claim 1 wherein said light reflective particles are made from a material selected from the group containing aluminum foil, polyester foil, holographic film and metallized polyester.

8. A light reflective golf ball comprising:

a core:

a resin cover surrounding said core;

a protective clear coating on said resin cover; and a plurality of individual light reflective particles suspended in said clear coating.

9. The golf ball of claim 8 wherein said light reflective particles range in size from 0.002 inches square to 0.125 inches square.

10. The golf ball of claim 8 wherein said particles are made from holographic film.

11. The golf ball of claim 8 wherein said particles cover approximately 5% to 75% of a surface area of said resin cover.

12. The golf ball of claim 8 wherein said resin cover is comprised of a resin material selected from the group containing balata and ionomers.

13. A method of making a light reflective golf ball comprising the steps of:

bonding a cover about a core:

painting said cover; and applying a clear coat to said painted cover, said clear coat having a plurality of discrete light reflective particles suspended therein, said step of applying said clear coat resulting in said light reflective particles being randomly dispersed over said painted cover.

* * * * *